US010219623B1

(12) United States Patent
Dibdin et al.

(10) Patent No.: US 10,219,623 B1
(45) Date of Patent: Mar. 5, 2019

(54) EXPANDING DRAWER DIVIDER

(71) Applicant: Helen of Troy Limited, Belleville, St. Michael (BB)

(72) Inventors: Steven Dibdin, Bloomfield, NJ (US); David Colie Wight, West Orange, NJ (US); Daniel Juda, Brooklyn, NY (US); Edward J. Laganis, Hoboken, NJ (US)

(73) Assignee: Helen of Troy Limited, St. Michael (BB)

( * ) Notice: Subject to any disclaimer, the term of this patent is extended or adjusted under 35 U.S.C. 154(b) by 0 days.

(21) Appl. No.: 15/697,968

(22) Filed: Sep. 7, 2017

(51) Int. Cl.
*A47F 5/00* (2006.01)
*A47B 88/975* (2017.01)
*A47B 88/90* (2017.01)

(52) U.S. Cl.
CPC ..... *A47B 88/975* (2017.01); *A47B 88/90* (2017.01); *A47F 5/005* (2013.01)

(58) Field of Classification Search
CPC ..... A47B 88/90; A47B 88/975; A47B 57/58; A47B 57/583; A47B 57/586; A47B 57/588; A47B 65/10; A47B 65/15; A47B 96/04; A47F 5/005; A47F 5/132; A47F 7/144
USPC ..... 211/175, 185, 184; 49/50, 55, 57, 450
See application file for complete search history.

(56) References Cited

U.S. PATENT DOCUMENTS 1,849,024 A * 3/1932 McKee ..... A47B 88/90 160/216
2,739,027 A * 3/1956 Gussack ..... A47B 88/493 312/333
4,191,299 A 3/1980 Moore
4,607,455 A * 8/1986 Bluem ..... E06B 3/92 49/367
5,052,461 A * 10/1991 Stern ..... E06B 9/04 160/216
5,285,596 A * 2/1994 Kinsey ..... E05B 65/0876 16/81
5,367,829 A * 11/1994 Crossley ..... E05B 65/0014 49/465
5,528,859 A * 6/1996 Taylor ..... E06B 9/02 160/225
5,535,552 A * 7/1996 Stern ..... E06B 9/02 160/225
5,570,543 A * 11/1996 Bishop ..... E05B 65/0014 160/216
5,924,242 A * 7/1999 Macari ..... E06B 9/02 49/463

(Continued)

FOREIGN PATENT DOCUMENTS

EP 2 684 490 1/2014

*Primary Examiner* — Kimberley S Wright
(74) *Attorney, Agent, or Firm* — Rankin, Hill & Clark LLP

(57) ABSTRACT

An expandable drawer divider includes a first panel, a second panel and a lock mechanism. The second panel is slidably connected to the first panel. The locking mechanism includes a lever and a lock member operably connected to the lever. The lever is configured to pivot about a pivot axis oriented perpendicular to a longitudinal axis of the divider toward a first position wherein the lock member is moved in a direction parallel to the longitudinal axis into engagement with the second panel and pivot toward a second position wherein the lock member is disengaged from the second panel and the second panel is movable relative to the first panel.

18 Claims, 13 Drawing Sheets

(56) References Cited

U.S. PATENT DOCUMENTS

| | | | | |
|---|---|---|---|---|
| 6,112,461 | A * | 9/2000 | Cheng | E06B 9/04 292/DIG. 12 |
| 6,449,901 | B1 * | 9/2002 | Gibree | E06B 9/02 49/465 |
| 6,991,307 | B2 * | 1/2006 | Hoenig | A47B 88/90 211/184 |
| 7,627,985 | B2 * | 12/2009 | Marsden | E05B 65/0014 49/394 |
| 7,645,001 | B2 * | 1/2010 | Harris | A47B 96/025 312/205 |
| 8,276,766 | B2 | 10/2012 | Rataiczak, III et al. | |
| 8,418,407 | B2 * | 4/2013 | Wang | E06B 9/0623 49/463 |
| 8,556,092 | B2 * | 10/2013 | Valiulis | A47F 5/005 108/61 |
| 9,549,623 | B1 | 1/2017 | Snell et al. | |
| 2003/0137227 | A1 * | 7/2003 | Hoenig | A47B 88/90 312/348.3 |
| 2003/0226815 | A1 * | 12/2003 | Gaunt | A47B 45/00 211/153 |
| 2013/0020270 | A1 * | 1/2013 | Valiulis | A47F 5/005 211/59.2 |

* cited by examiner

EXPANDING DRAWER DIVIDER

BACKGROUND

Partitioning devices, such as drawer dividers, are popular devices which serve to organize, sort, and/or segregate items within a compartment or drawer. Traditionally, drawer dividers rely on spring-compression force to hold the divider in place. A user of the device squeezes the divider to compress it to a length that will fit within the drawer, then releases to allow the spring's compression force to hold the divider in place. However, the springs lose tension over time, causing spring-loaded dividers to become loose over time and move within the drawer. Moreover, the force holding a spring-loaded divider in place is sometimes insufficient for a drawer about the width of the spring-loaded divider.

SUMMARY

According to one aspect, an expandable drawer divider comprises a first panel, a second panel and a lock mechanism. The second panel is slidably connected to the first panel. The locking mechanism includes a lever and a lock member operably connected to the lever. The lever is configured to pivot about a pivot axis oriented perpendicular to a longitudinal axis of the divider toward a first position wherein the lock member is moved in a direction parallel to the longitudinal axis into engagement with the second panel and pivot toward a second position wherein the lock member is disengaged from the second panel and the second panel is movable relative to the first panel.

According to another aspect, an expandable drawer divider comprises a first panel, a second panel and a lock mechanism. The second panel is slidably connected to the first panel. The locking mechanism includes a lever, a lock member operably connected to the lever, and a linear rack provided on the second panel. The lever is configured to pivot toward a first position wherein the lock member is moved in a longitudinal direction of the divider and then in a direction perpendicular to the longitudinal axis of the divider into engagement with the linear rack. The lever is configured to pivot toward a second position wherein the lock member is disengaged from the linear rack and the second panel is movable relative to the first panel.

DETAILED DESCRIPTION

Figure 1:
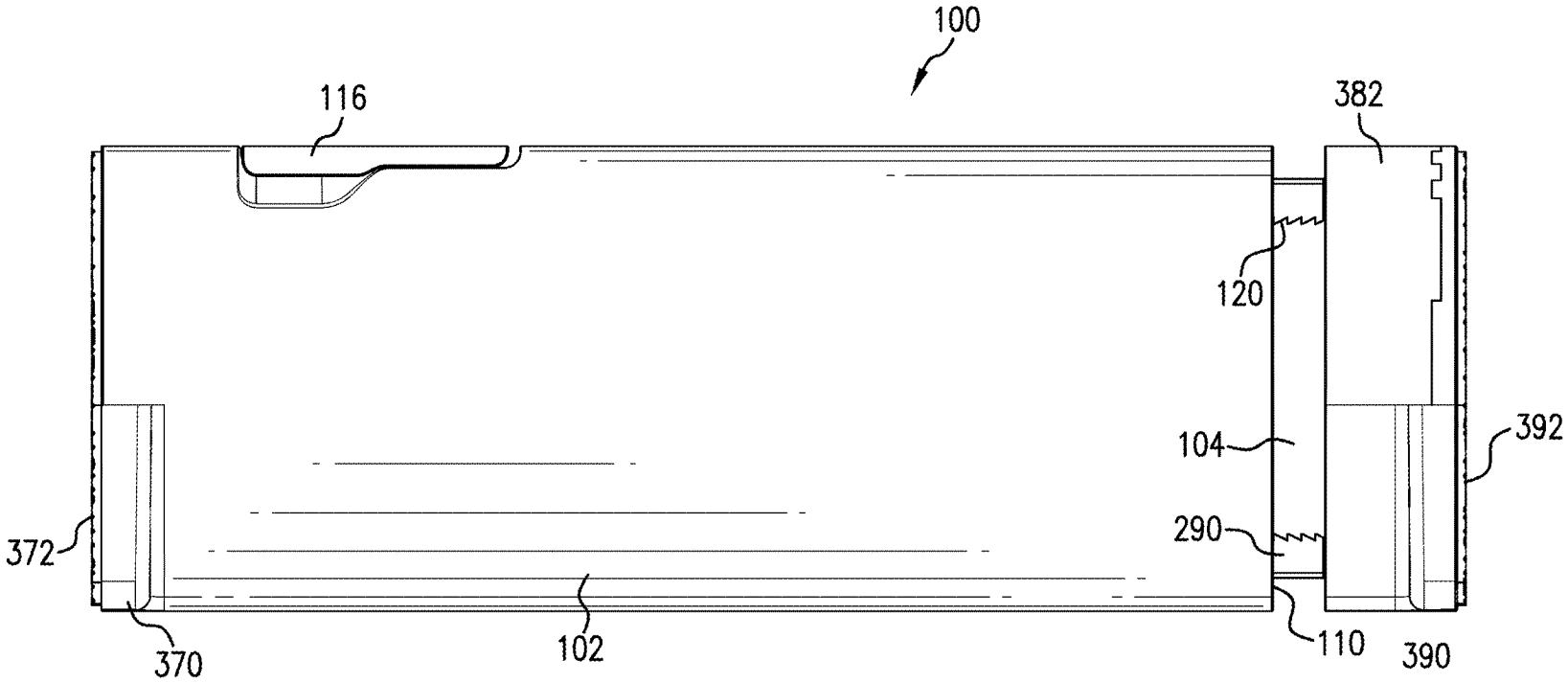
FIG. 1 is a side view of an exemplary expandable drawer divider according to the present disclosure, the drawer divider in a locked state.
Figure 2:
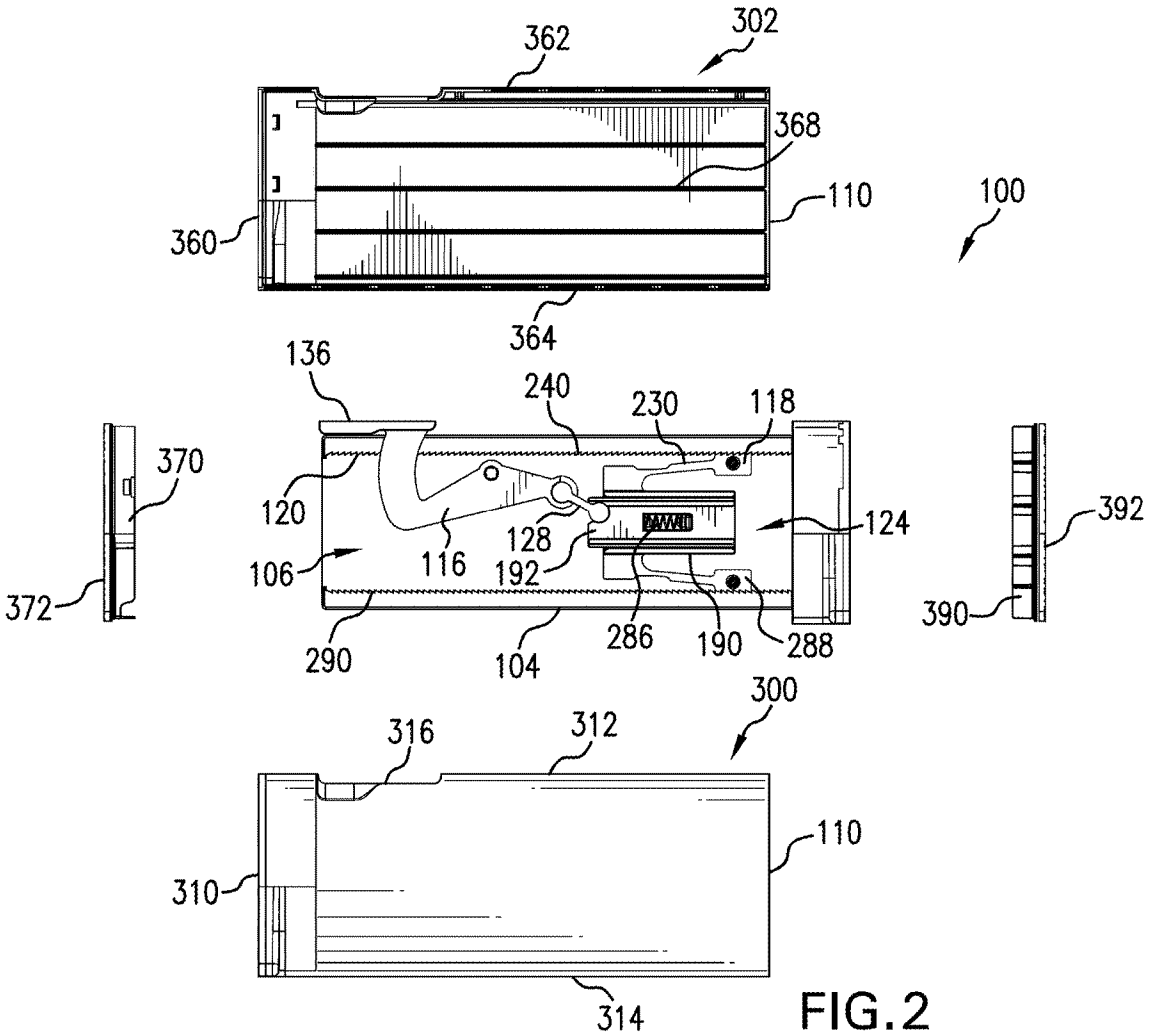
FIG. 2 is an exploded side view of the drawer divider of FIG. 1.

It should, of course, be understood that the description and drawings herein are merely illustrative and that various modifications and changes can be made in the structures disclosed without departing from the present disclosure. Referring now to the drawings, wherein like numerals refer to like parts throughout the several views, FIGS. 1 and 2 illustrate an expandable drawer divider 100 according to the present disclosure, the drawer divider in a locked state. The drawer divider 100 generally comprising a first panel 102, a second panel 104 and a lock mechanism 106. In the depicted embodiment, the first panel 102 has an open end 110, and the second panel 104 is at least partially received through the open end 110 and slidably connected to the first panel 102 allowing for the telescoping movement of the second panel 104 relative to the first panel 102 in a longitudinal direction of the drawer divider 100. However; this is not required, and it is contemplated that the second panel 104 can by juxtaposed to the first panel and connected for sliding movement relative to the first panel. The exemplary lock mechanism 106 generally includes a lever 116 and a lock member 118 operably connected to the lever 116. In the illustrated aspect, the lock mechanism can further include a linear rack 120 provided on the second panel 104. As will be described below, the lever 116 is configured to pivot about a pivot axis oriented perpendicular to a longitudinal axis of the divider 100 (which is parallel to the longitudinal direction) toward a first position (FIGS. 1 and 11) wherein the lock member 118 is moved in a direction parallel to the longitudinal axis into engagement with the second panel 104 (for example, the linear rack 120) and pivot toward a second position (FIG. 12) wherein the lock member 118 is disengaged from the second panel 104 (for example, the linear rack 120) and the second panel 104 is movable relative to the first panel 102.

Figure 3:
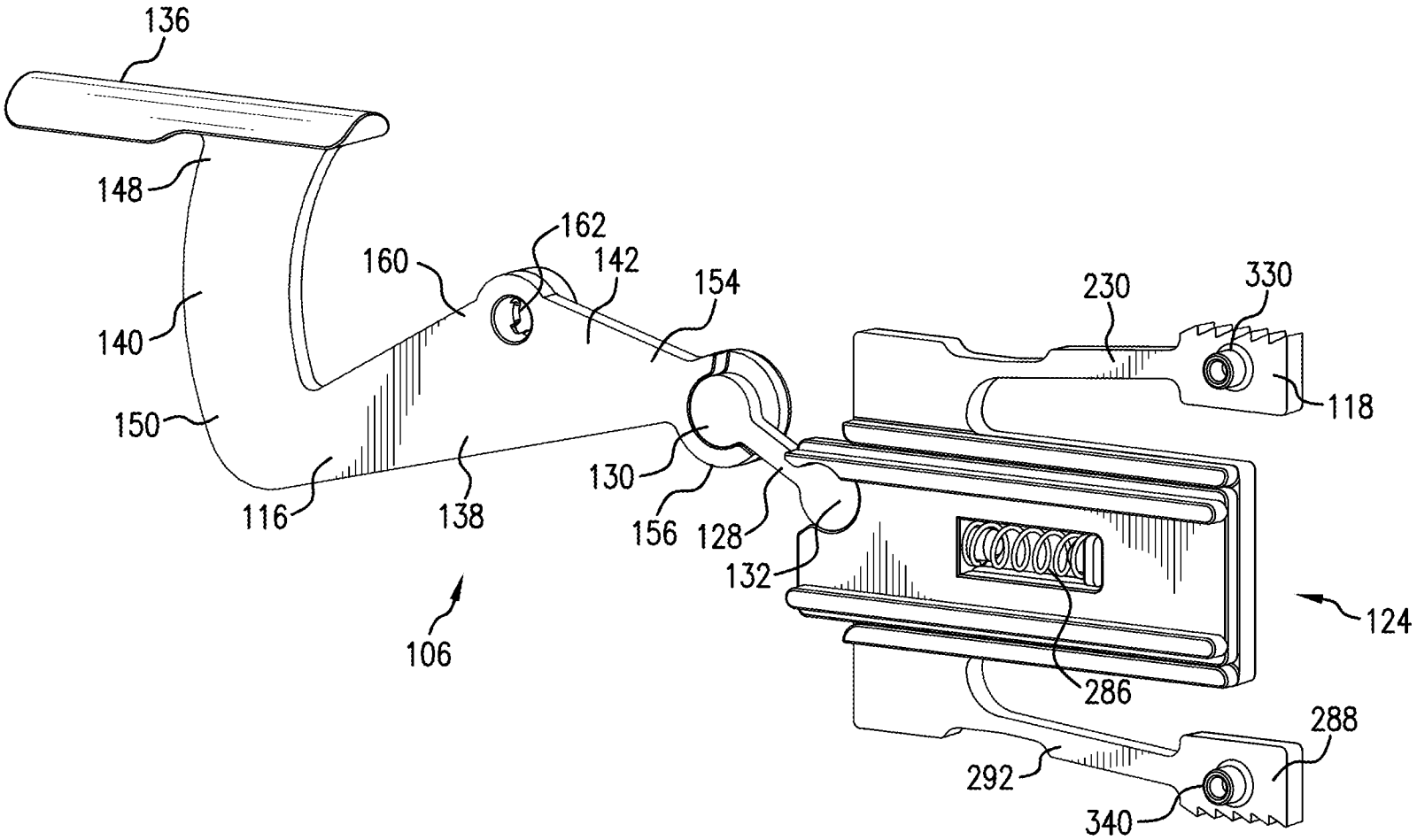
FIGS. 3 and 4 are side perspective views of an exemplary lock mechanism for the drawer divider.
Figure 4:
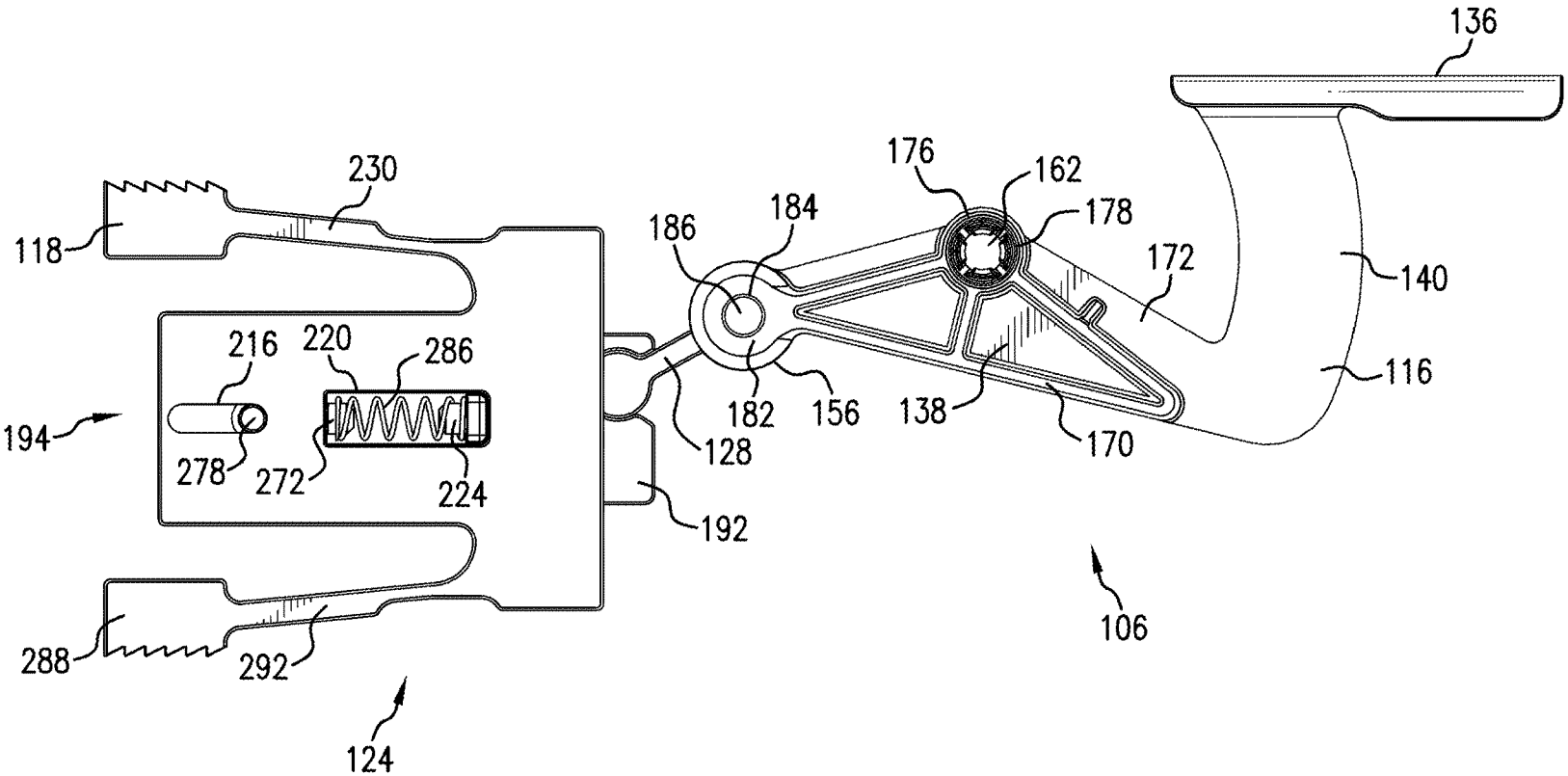
Figure 5:
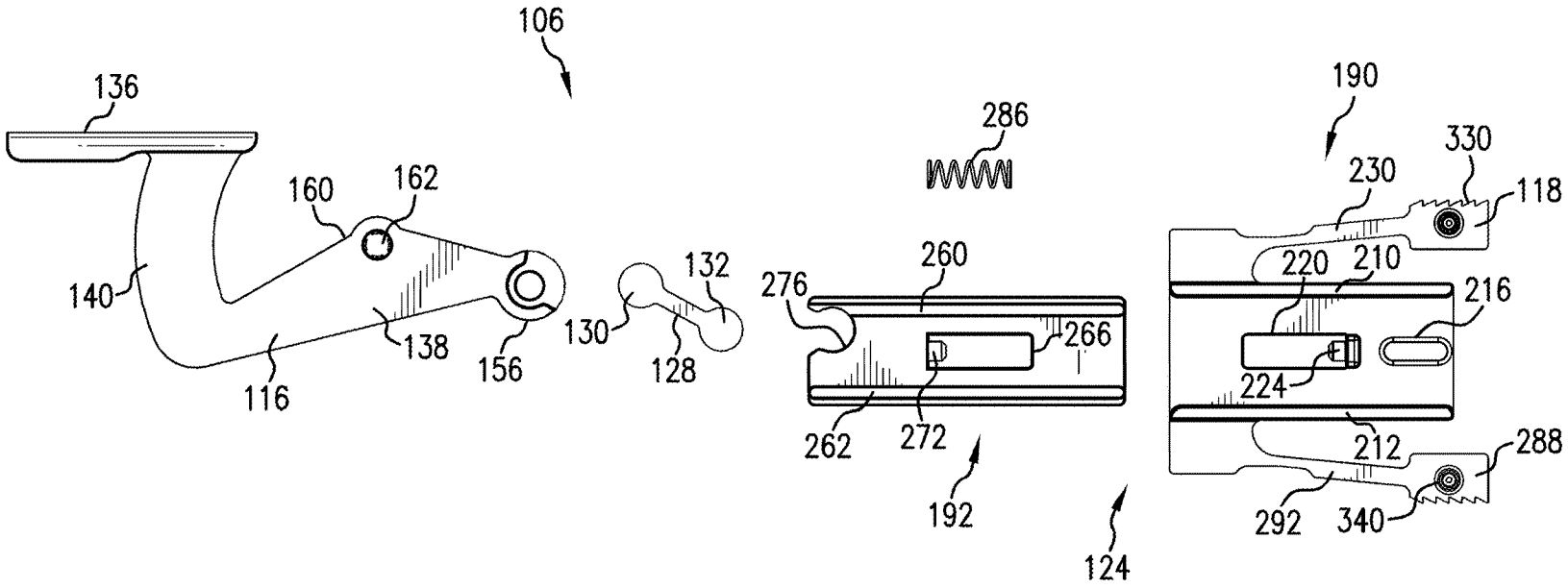
FIG. 5 is an exploded side view of the lock mechanism.

With reference to FIGS. 3-5, the exemplary lock mechanism 106 further includes a compliant part 124 having the lock member 118. The compliant part 124 is coupled to the lever 116 via a link 128 having a first end 130 pivotally connected to the lever 116 and a second end 132 pivotally connected to the compliant part 124. With the lever 116 coupled to the compliant part 124, the compliant part moves in the direction parallel to the longitudinal axis as the lever 116 is pivoted between the first and second positions. The lever 116 includes a handle 136 and an arm 138. In the depicted aspect, the arm 138 is defined by a first arm section 140 and a second arm section 142, which together are substantially L-shaped in side view. The first arm section 140 includes a first end portion 148 connected to the handle 136 and a second end portion 150. The second arm section 142 extends from the second end portion 150 of the first arm section toward the compliant part 124, with a distal end portion 154 of the second arm section 142 provided with a seat 156 configured to pivotally receive the first end 130 of the link 128. In the illustrated aspect, located substantially centrally on the second arm section 142 is a budging portion 160 having an opening 162 extending therethrough. The opening 162 is sized to receive a post 166 provided on the first panel 102 (FIG. 8), which pivotally mounts the lever 116 to the first panel 102 (the post 166 defining the pivot axis of the lever 116). With this arrangement, the pivot axis of the lever 116 is offset in a height direction of the divider 100 (when the lever is in the first position) from the connection of the link 128 with the lever 116. Ribs 170 can be provided on a surface 172 of the second arm section 142 to provide strength and rigidity to the lever 116. The ribs 170 can form a first mounting boss 176 having the opening 162, and retaining features 178 can be located on the first mounting boss 176 for engaging the post 166. A second mounting boss 182 can be provided at the seat 156, the second mounting boss 182 having an opening 184 sized to receive a post 186 located on the first end 130 of the link 128.

Figure 6:
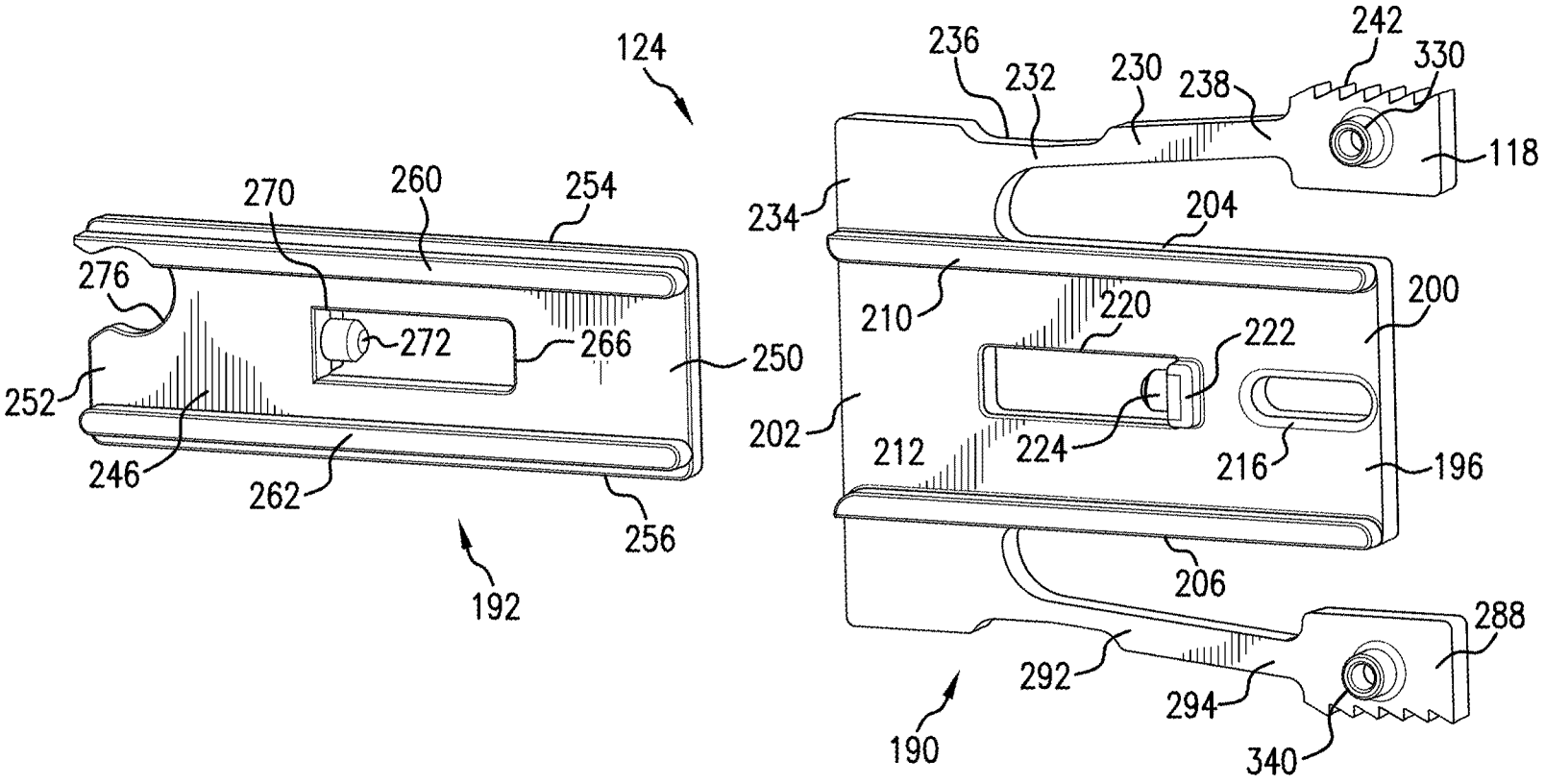
FIGS. 6 and 7 are side perspective views of first and second slide members of a compliant part of the lock mechanism.
Figure 7:
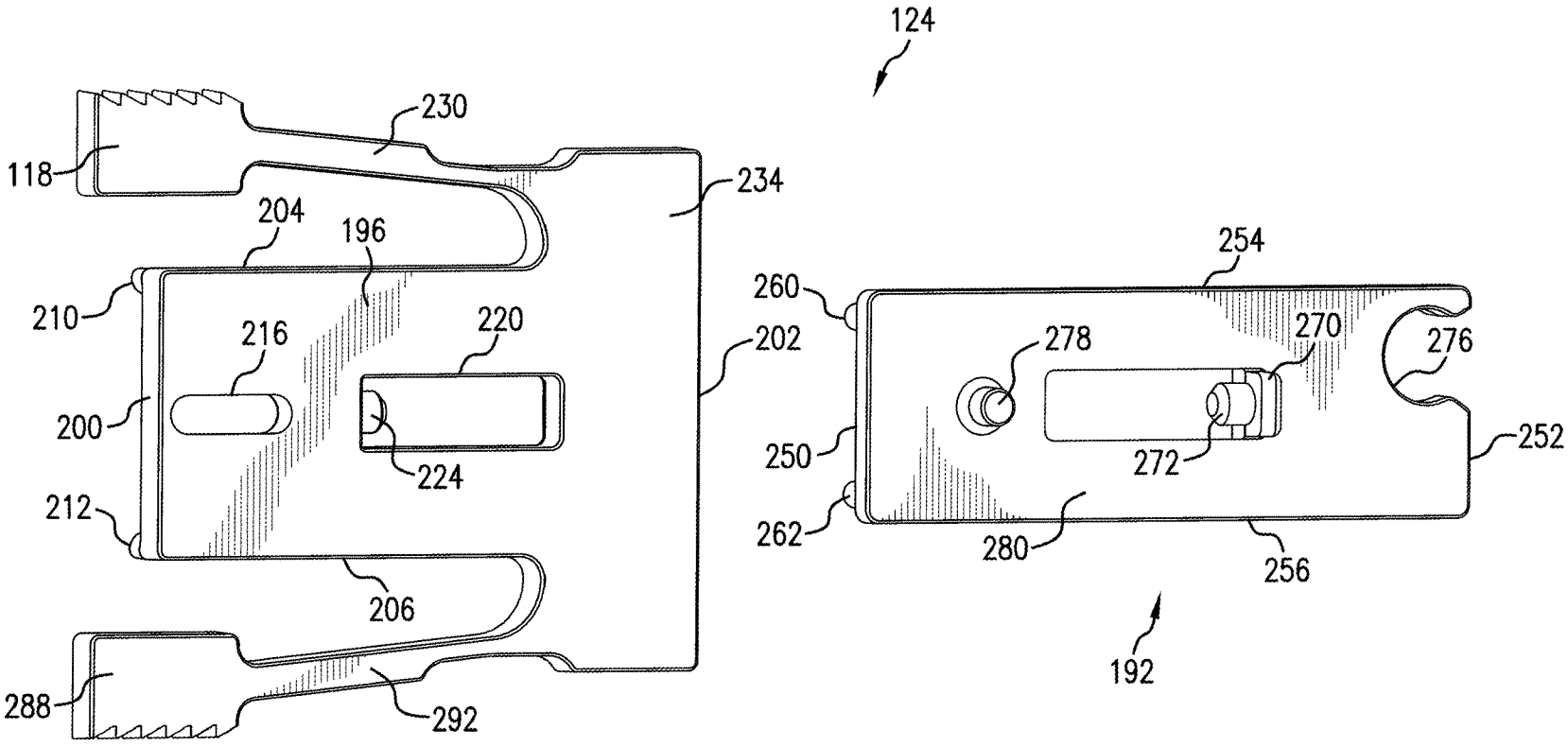

According to one aspect, the compliant part 124 includes a first slide member 190 and a second slide member 192 connected to the first slide member. As will be described below, the compliant part 124 is configured to allow for sliding movement of one of the first and second slide members 190, 192 relative to the other of the first and second slide members as the lever 116 is moved between the first position and second position. The exemplary features of the first and second slide members 190, 192 are best depicted in FIGS. 6 and 7. The first slide member 190 includes a base 196 which defines a support for the second slide member 192. The base 196 can be rectangular shaped in side view with opposite first and second ends 200, 202 and opposite first and second sides 204, 206. A pair of spaced apart longitudinal rails 210, 212 extend along the respective first and second sides 204, 206. A first slotted opening 216, which can be obround shaped with a longitudinal axis extending in a length direction of the base 196, is provided on the base 196 at the first end 200. A second slotted opening 220, which can be rectangular shaped with a longitudinal axis extending in the length direction of the base 196, is locate substantially centrally on the base 196. Provided at an end of second slotted opening 220 (nearest to the first end 200) is a tab 222. The tab 222 extends outwardly from the base 196 and includes a post 224 directed toward the second end 202.

According to the present disclosure, a locking arm 230 extends outwardly from the first side 204 of the base 196 (and toward a longitudinal side of the second panel 104 in the assembled condition of the divider 100). As shown, a proximal end portion 232 of the locking arm 230 is connected to a shoulder 234 provided at the first side 204 near the second end 202 of the base 196. A recess or cutout 236 is located at the connection of the proximal end portion 232 and shoulder 234, which provides for a reduced width of the proximal end portion 232 compared to a width of a distal end portion 238 of the locking arm 230. The lock member 118 is provided at the distal end portion 238 of the locking arm 230, and the above reduced dimension allows for the displacement of the lock member 118 relative to the base 196. As depicted, the lock member 118 includes teeth 242 for engaging teeth 240 of the linear rack 120 (see FIG. 2).

The second slide member 192 includes a base 246, and similar to the base 196, the base 246 can be rectangular shaped in side view with opposite first and second ends 250, 252 and opposite first and second sides 254, 256. A pair of spaced apart longitudinal rails 260, 262 extend along the respective first and second sides 254, 256. A slotted opening 266, which can be rectangular shaped with a longitudinal axis extending in the length direction of the base 246, is locate substantially centrally on the base 246. As depicted, the slotted opening 266 is sized approximately equal to the second slotted opening 220. Provided at an end of the slotted opening 266 (nearest the second end 252 of the base 246) is a tab 270. The tab 270 extends outwardly from the base 246 (in a direction opposite of the tab 222) and includes a post 272 directed toward the first end 250. A substantially C-shaped cutout 276 is located at the second end 252. The cutout 276 is sized to receive the second end 132 of the link 128 (see FIG. 3), thereby pivotally connecting the link 128 to the second slide member 192. A projection 278 further is provided on a back surface 280 of the base 246.

Figure 11:
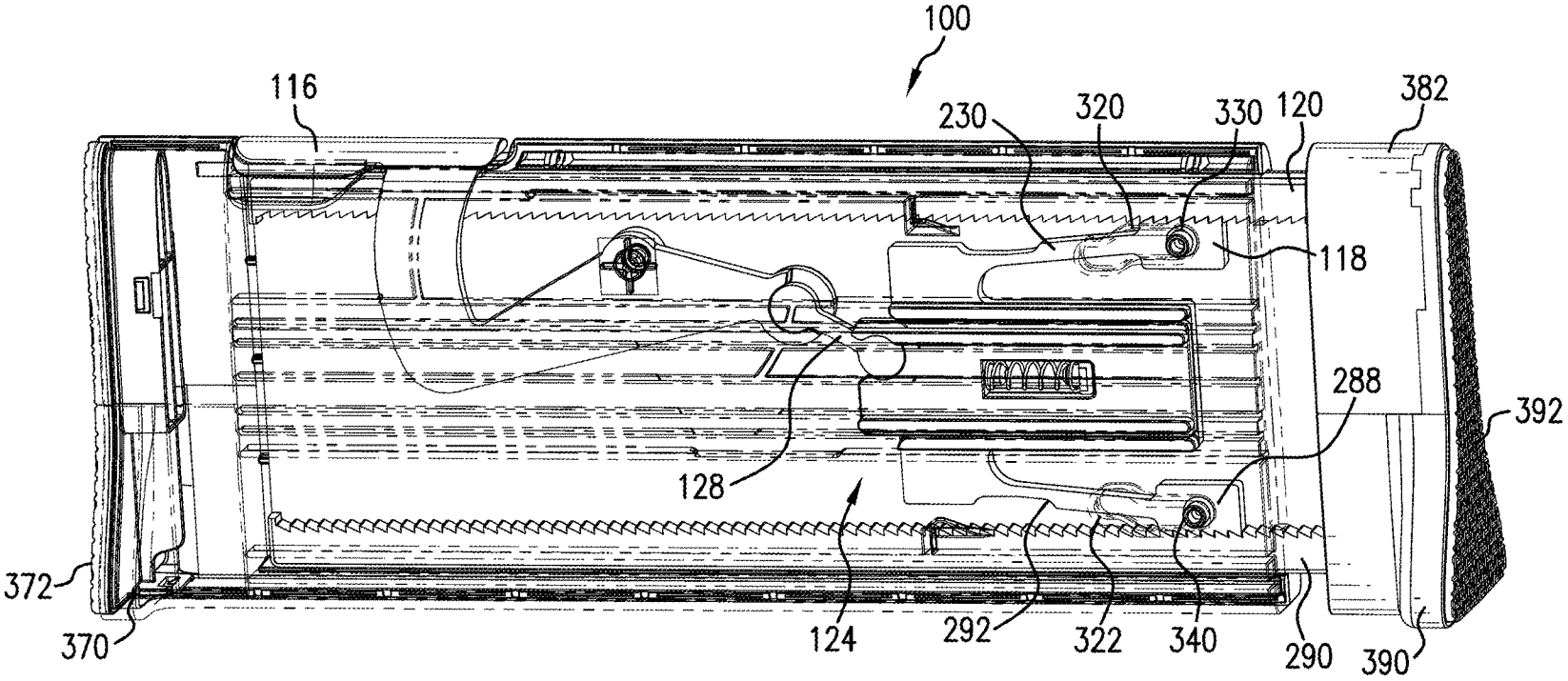
FIG. 11 is a side view of the drawer divider of FIG. 1 with the first panel part transparent.
Figure 12:
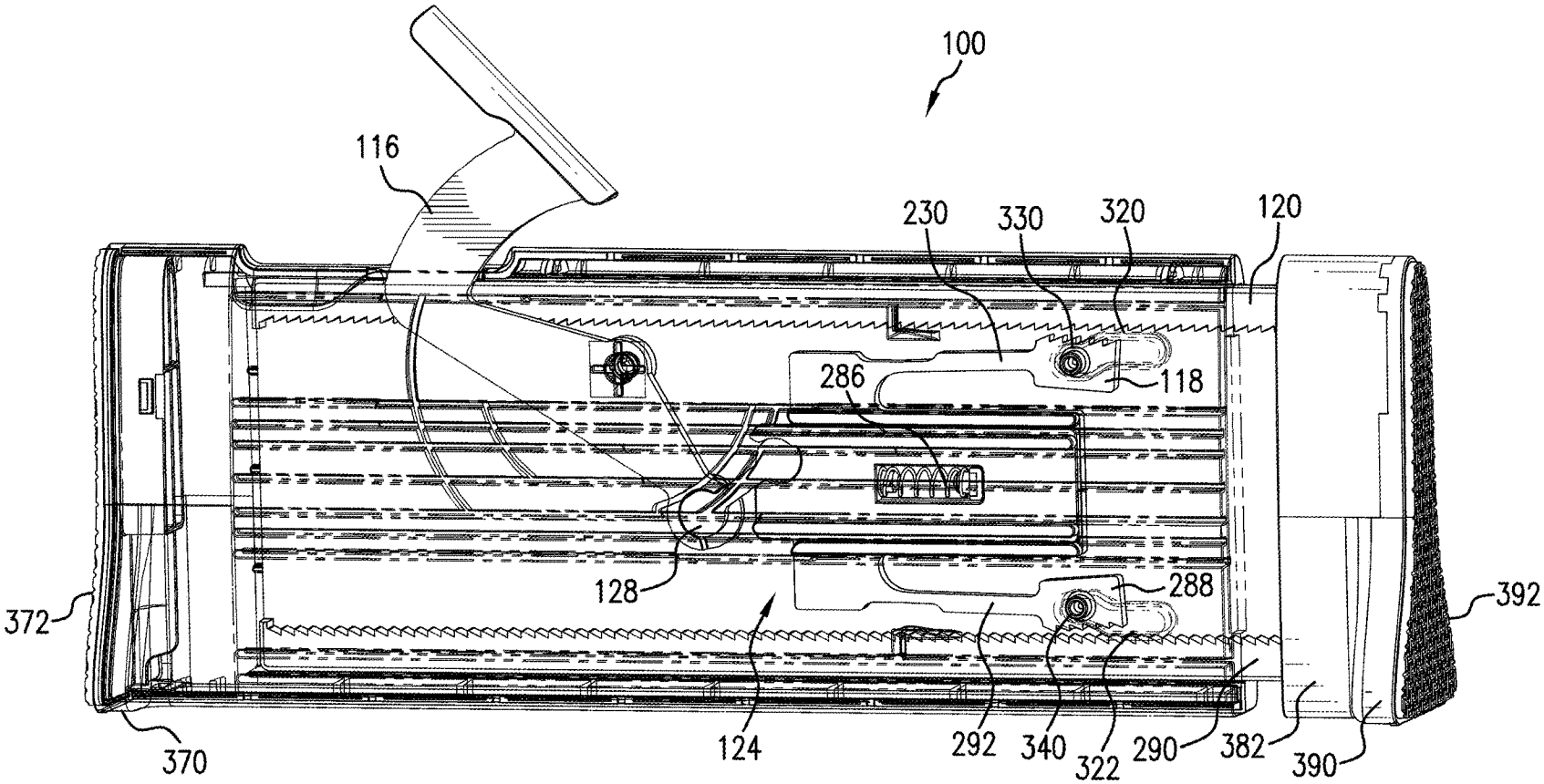
FIG. 12 is a side view of the drawer divider with the first panel part transparent, the drawer divider in an unlocked state.
Figure 13:
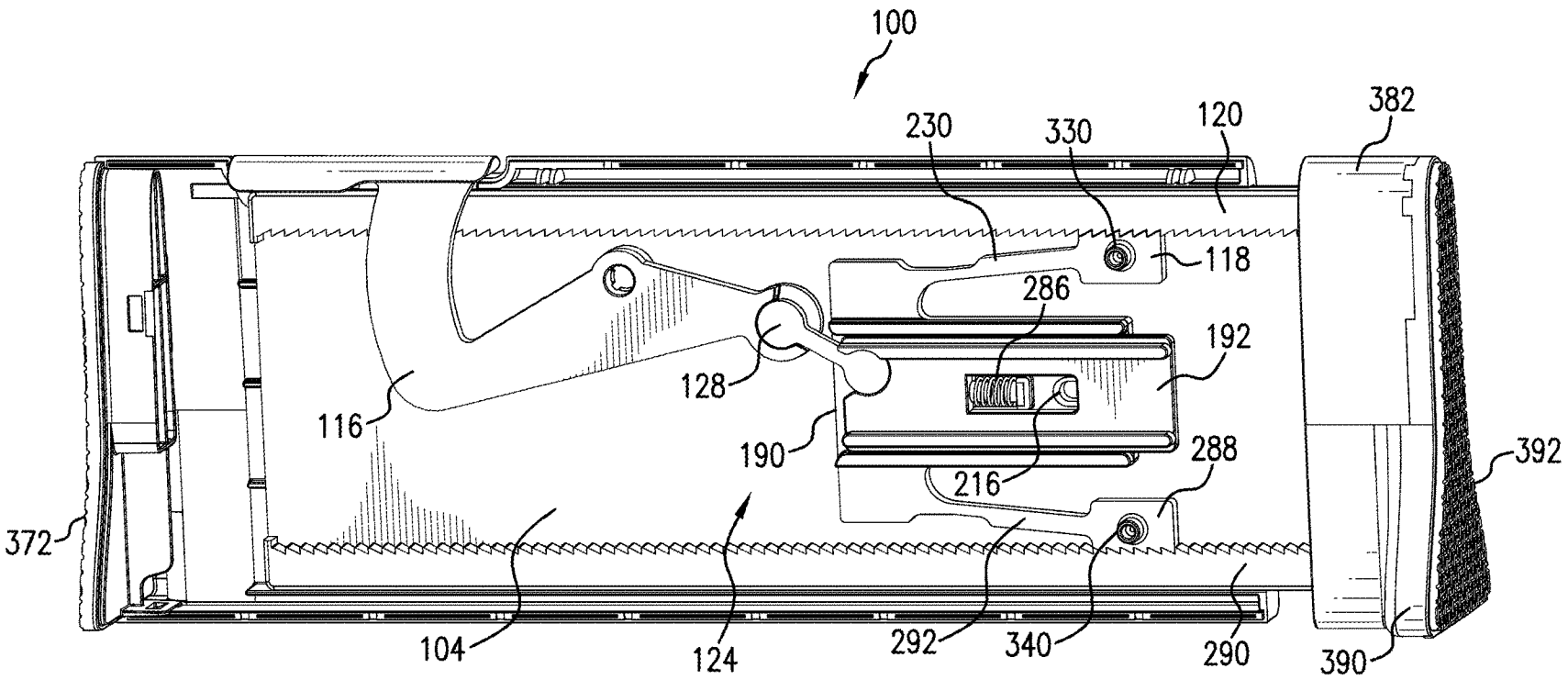
FIG. 13 is a side view of the drawer divider with the first panel part removed and the second slide member offset from the first slide member.

In the assembled condition of the exemplary compliant part 124, shown in FIGS. 3 and 4, the base 246 of the second slide member 192 is slidably received between the rails 210, 212 of the first slide member 190. The projection 278 is slidably received in the first slotted opening 216, and it should be appreciated that a length of the first slotted opening 216 defines a travel distance that first and second slide members 190, 192 are movable relative to one another. The tab 222 is slidably received in the slotted opening 266 and the tab 270 is slidably received in the second slotted opening 220, and this arrangement of the tabs 222, 270 ensures that the post 224 is aligned with the post 272. And according to one aspect, a biasing member 286 is connected between the first slide member 190 and the second slide member 192 which ensures that the first and second slide members 190, 192 move in unison as the lever 116 is moved between its first and second positions (FIGS. 11 and 12). In the depicted embodiment, the biasing member is a spring 286 which is secured to the posts 224, 272 of the respective tabs 222, 274, the spring 286 adapted to bias the first and second slide members 192, 194 to their respective positions shown in FIG. 3. It should be appreciated that as the lever 116 is moved to the first position and the lock member 118 initially engages the linear rack 120 further movement of the lever 116 to the first position can cause the second slide member 192 to move relative to the first slide member 190 toward the open end 110 of the first panel 102. As shown in FIG. 13, this, in turn, compresses the spring 286 and this force further presses the lock member 118 into engagement with the linear rack 120. It should also be appreciated that in the first position of the lever 116, the travel distance defined by the first slotted opening 216 is the travel distance that the second panel 104 is movable relative to the first panel 102. To release the lock mechanism 106, the lever 116 is pivoted toward the second position (FIG. 12), the lock member 118 is disengaged from the linear rack 120 and the spring 286 moves the first and second slide members 192, 194 back toward their respective positions shown in FIG. 3.

In the illustrated embodiment of the lock mechanism 106 the lock member 118 is a first lock member and the linear rack 120 is a first linear gear, and the lock mechanism 106 can further include a second lock member 288 operably connected to the lever 116 and a second linear rack 290 provided on the second panel 104. The locking arm 230 of the compliant part 114 is a first locking arm provided with the first lock member 118, and the compliant part 124 further includes a second locking arm 292 provided with the second lock member 288 at its distal end portion 294. Each or the first and second locking arms 230, 292 is configured to be displaced in a direction perpendicular to the longitudinal axis of the divider 100 (e.g., in the height direction of the divider 100) as the lever 116 is pivoted between the first position (FIG. 11) and second position (FIG. 12).

Figure 8:
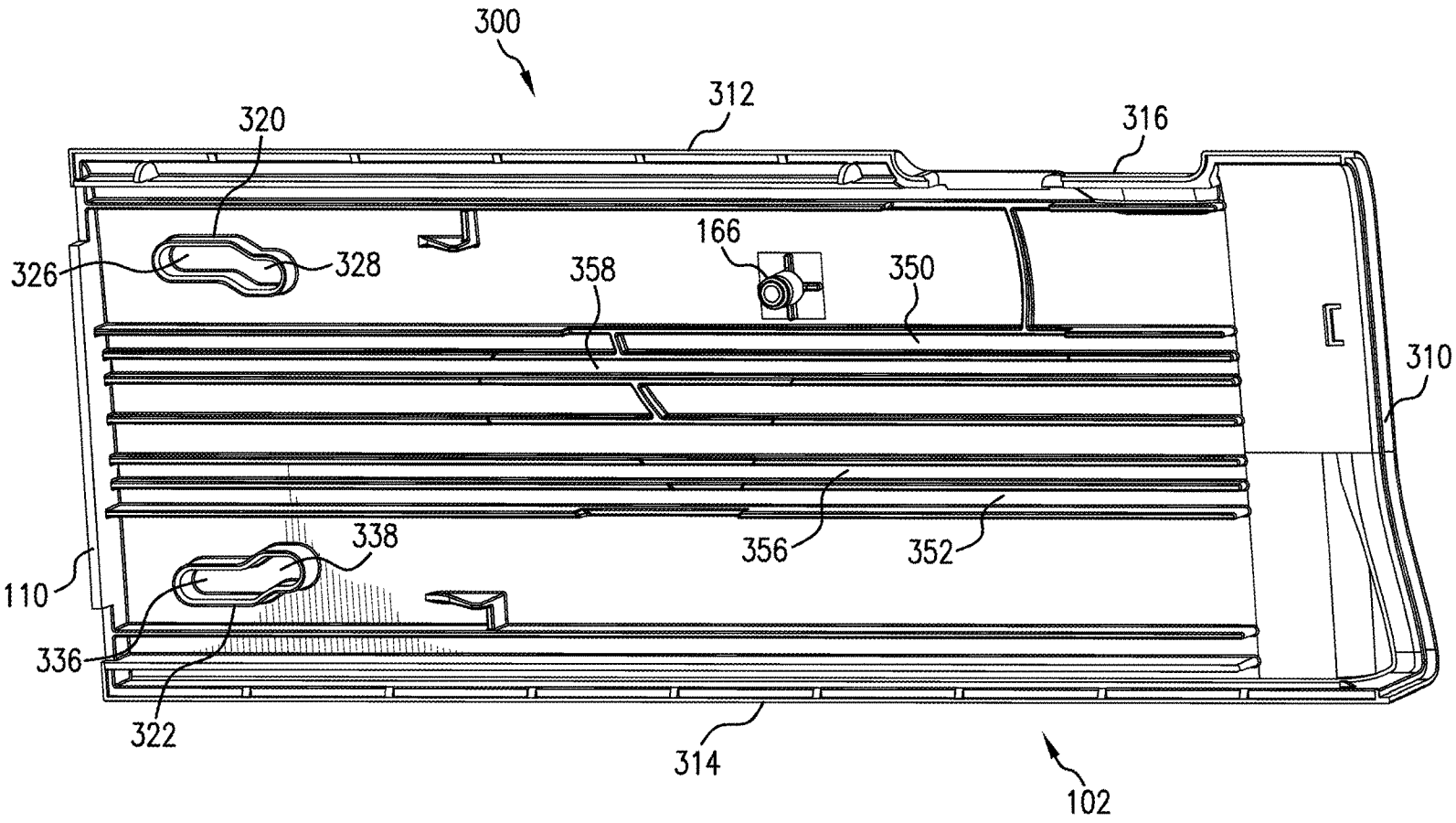
FIG. 8 is a side perspective view of a first panel part of a first panel of the drawer divider.
Figure 9:
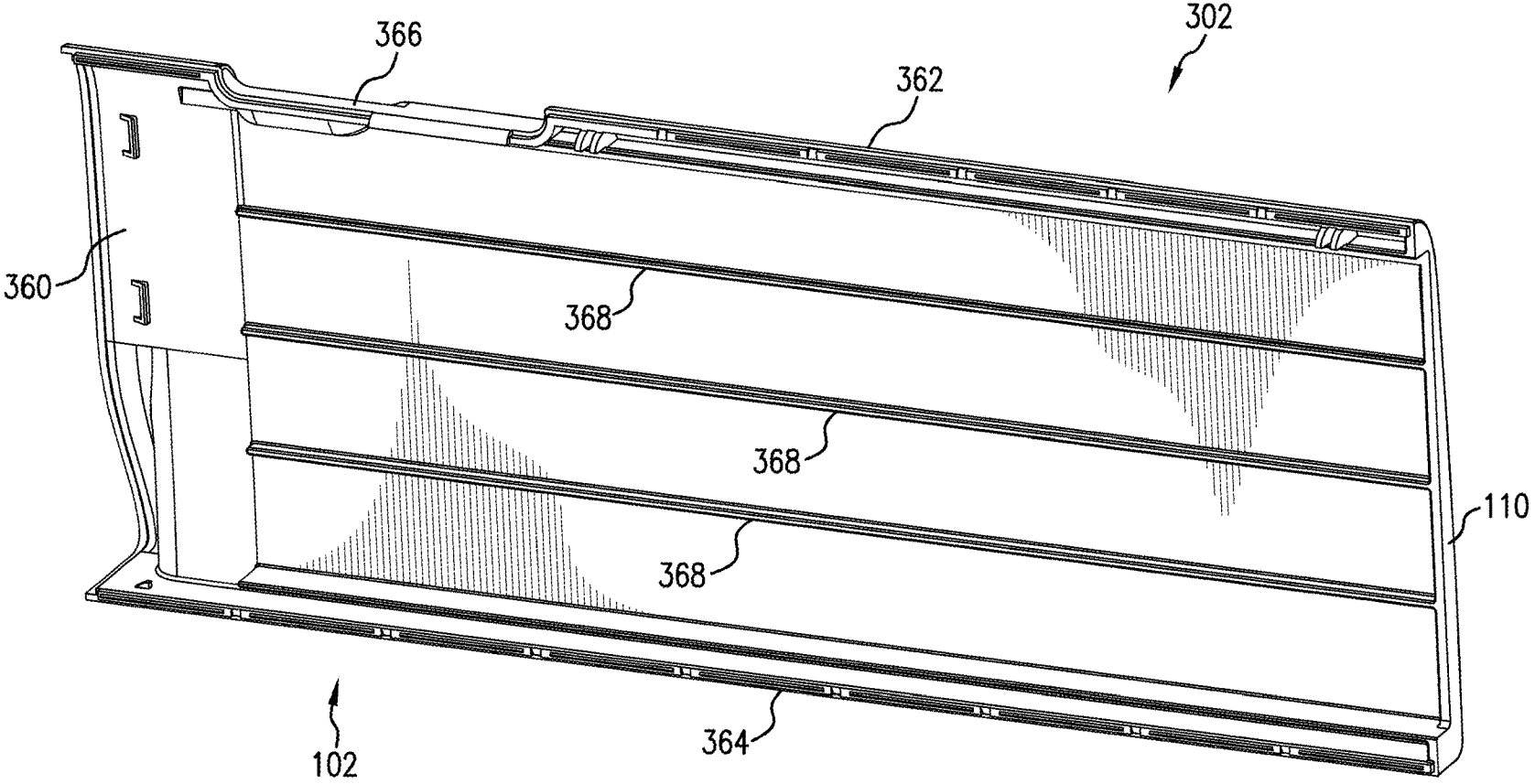
FIG. 9 is a side perspective view of a second panel part of the first panel of the drawer divider.

To allow for the sliding movement of above mentioned components of the lock mechanism 106 within the first panel 102, guide tracks are provided on the first panel 102. With reference to FIGS. 8 and 9, the first panel 102 includes a first panel part 300 and a second panel part 302 connected to the first panel part. The first panel part 300 includes a portion of the open end 110, an opposite end 310, a first longitudinal side 312 and a second longitudinal side 314. The first side 312 includes a cutout 316 for the lever 116. A pair of first guide tracks 320, 322 for guiding the sliding movement of the respective first and second lock members 118, 288 are located near the open end 110. The first guide track 320 includes a first section 326 and a second section 328 offset from the first section in a direction perpendicular to the longitudinal axis (e.g., in the height direction of the divider 100). The first lock member 118 includes a post 330 that is slidingly received in the first guide track 320, and the post 300 is in the first section 326 in the first position of the lever 116 (FIG. 11) and is in the second section 328 in second position of the lever 116 (FIG. 12). Similarly, the first guide track 322 includes a first section 336 and a second section 338 offset from the first section, for example, in the height direction of the divider 100. The second lock member 118 includes a post 340 that is slidingly received the first guide track 322, and the post 300 is in the first section 336 in the first position of the lever 116 and is in the second section 338 in second position of the lever 116. It should be appreciated that a length of each of the first sections 326, 336 is approximately equal to a length of the first slotted opening 216. The first panel part 300 further includes a pair of second guide tracks 350, 352 which slidingly receive the respective rails 210, 212 of the first slide member 190, and a pair of third guide tracks 356, 358 which slidingly receive the respective rails 260, 262 of the second slide member 192. The second panel part 302 includes a portion of the open end 110, an opposite end 360, a first longitudinal side 362 and a second longitudinal side 364. The first side 362 includes a cutout 366 for the lever 116. Longitudinal extending ribs 368 can be located on the second panel part 302 to provided additional strength and rigidity to the first panel 102.

As depicted in FIGS. 1 and 2, the exemplary divider 100 further includes a first end support member 370 connected at one end of the first panel 102. The first end support member 370 provides additional surface area where the ends of the divider 100 would contact the walls of a compartment or drawer. According to one aspect, the first end support member 370 includes a friction pad 372. The friction pad 372 provides increased friction, especially when compressed, between the walls of a compartment and the first end support member 370 so as to decrease movement of the divider 100 within the compartment. The friction pad 372 may also act as cushion, preventing the outward force of the divider 100 from damaging the walls of the compartment. The friction pad 372 may be made of any suitable material, such as, for example, natural or synthetic rubber, foam, or soft polymers. The friction pad 372 may cover the whole surface of the first end support member 370 or any part of it. The friction pad 372 may also be made of several smaller friction pads affixed to the first end support member 370. The friction pad 372 may be connected to the first end support member 370 by any known suitable manner.

Figure 10:
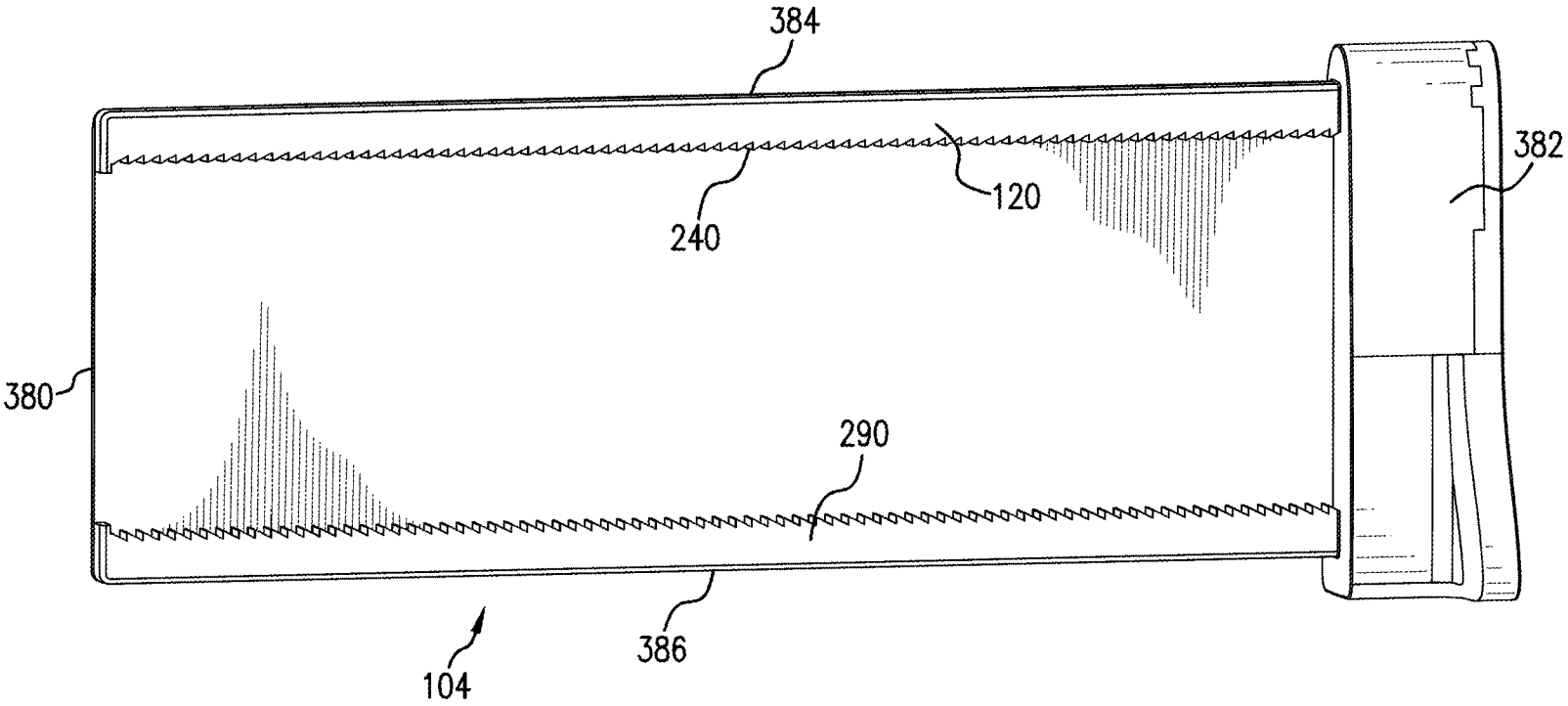
FIG. 10 is a side perspective view of a second panel of the drawer divider.

FIG. 10 depicts the second panel 104. The second panel 104 include a first end 380, a second end 382, a first longitudinal side 384, and a second longitudinal side 386. The first linear rack 120 is adjacent to and extends along the first longitudinal side 384 and the second linear rack 290 is adjacent to and extends along the second longitudinal side 386 of the second panel. With reference back to FIGS. 1 and 2, the exemplary divider 100 further includes a second end support member 390 connected to the second end 382 of the second panel 104. Similar to the first end support member 370, in some embodiments the second end support member 390 includes a friction pad 392. The friction pad 392 can be constructed similar to the friction pad 372 and may be connected to the second end support member 390 by any known suitable manner.

In use, the exemplary divider 100 is placed in a compartment or drawer. The lever 116 is moved to its second position (FIG. 12) which allows for the sliding of the second panel 104 within the first panel 102. In the second position of the lever 116, the compliant part 124, which again is connected to the lever 116 via the link 128 and has the first and second lock members 118, 288 connected thereto, is located away from the open end 110 of the first panel 102. In this location, the first and second lock members 118, 288 are located in the respective second sections 328, 338 of the first guide tracks 320, 322. The second panel 104 is then extended into engagement with an inner surface of the drawer. The lever 116 moved toward the first position (FIG. 11) causes the compliant part 124 to slide toward the open end 110 of the first panel 102. As the compliant part 124 is moved, the first and second lock members 118, 288 slide through the respective first sections 326, 336 of the first guide tracks 320, 322 and into engagement with the first and second linear racks 120, 290. This engagement substantially fixes the position of the second panel 104 relative to the first panel 102 (again, in the first position of the lever 116 the second panel 104 is movable relative to the first panel 102). It should be appreciated that up to this point the first and second slide members 190, 192 of the compliant part are moving in unison. It should further be appreciated that pivoting the lever 116 to its first position can cause the second slide member 192 to move relative to the first slide member 190 (FIG. 13), comprising the biasing member (i.e., spring 286), pressing the first and second lock members 118, 288 into the first and second linear racks 120, 290, and thereby causing the exemplary divider 100 to expend slightly further. The force of the first and second lock members 118, 288 causes a slight outward expansion of the second panel 104, further securing the expandable drawer divider 100 within a drawer.

As indicated previously, in the depicted embodiment of the divider 100, the lock mechanism 106 includes the linear rack 120 and the lock member 118 includes teeth for engaging the linear rack 120 in the first position of the lever 116. However, alternative configurations for the lock mechanism are contemplated. By way of example, in lieu of the linear rack 120, the lock member 118 can include a friction pad for engagement with the second panel 104 in the first position of the lever 116. The friction pad may be made of any suitable material, such as, for example, natural or synthetic rubber, foam, or soft polymers. Further, according to this alternative, the second panel 104 can include a linear engaging surface having a corresponding friction pad. And the operation of the lock mechanism 106 would be the same as described above, except for the frictional engagement between the lock member 118 and the second panel 104 in the first position of the lever 116.

It will be appreciated that the above-disclosed features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An expandable drawer divider comprising:

a first panel and a second panel slidably connected to the first panel; and a locking mechanism including a lever and a lock member operably connected to the lever, the lock member connected to the first panel for selective engagement with the second panel, the lever configured to pivot about a pivot axis oriented perpendicular to a longitudinal axis of the divider toward a first position wherein the lock member is moved in a direction parallel to the longitudinal axis into engagement with the second panel and pivot toward a second position wherein the lock member is disengaged from the second panel and the second panel is movable relative to the first panel in the direction parallel to the longitudinal axis of the divider, wherein the lock member is a first lock member, and the locking mechanism further includes a second lock member operably connected to the lever and movable in a direction parallel to the longitudinal axis into engagement with the second panel, wherein a first guide track is provided on the first panel, the first lock member is slidably received in the guide track.

2. The divider of claim 1, wherein the first guide track includes a first section and a second section offset from the first section in a direction perpendicular to the longitudinal axis, the first lock member received in the first section in the first position of the lever and the first lock member received in the second section in second position of the lever.

3. The divider of claim 1, wherein the locking mechanism includes a compliant part and a link having a first end pivotally connected to the lever and a second end pivotally connected to the compliant part, the compliant part including the first lock member, wherein with the lever engaged to the compliant part the compliant part moves in the direction parallel to the longitudinal axis.

4. The divider of claim 3, wherein the compliant part includes a locking arm extending toward a longitudinal side of the second panel, the first lock member provided on a distal end portion of the locking arm.

5. The divider of claim 3, wherein the compliant part includes a first slide member and a second slide member connected to the first slide member, the first slide member including the first lock member, the link pivotally connected to the second slide member.

6. The divider of claim 5, wherein the first panel includes a second guide track, the first slide member slidably received in the second guide track, and the first panel includes a third guide track, the second slide member slidably received in the third guide track.

7. The divider of claim 5, wherein the compliant part is configured to allow for sliding movement of one of the first and second slide members relative to the other of the first and second slide members.

8. The divider of claim 7, wherein the compliant part further includes a biasing member connected between the first slide member and the second slide member.

9. The divider of claim 8, wherein in the first position of the lever the second slide member is adapted to move relative to the first slide member compressing the biasing member.

10. The divider of claim 9, wherein at least one of the first slide member and the second slide member is adapted to limit the movement of the second slide member relative to the first slide member.

11. The divider of claim 10, wherein the first slide member includes a slotted opening and the second slide member includes a projection slidably received in the opening, and wherein a length of the slotted opening defines a travel distance that the second slide member is movable relative to the first slide member, which is the travel distance that the second panel is movable relative to the first panel in the first position of the lever.

12. The divider of claim 1, wherein the locking mechanism further includes a first linear rack adjacent to and extending along a first longitudinal side of the second panel and a second linear rack adjacent to and extending along a second longitudinal side of the second panel, wherein the first lock member is moved into engagement with the first linear rack and the second lock member is moved into engagement with the second linear rack.

13. The divider of claim 1, wherein the locking mechanism further includes a compliant part and a link connecting the compliant part with the lever, the compliant part having a first arm provided with the first lock member and a second arm provided with the second lock member, each or the first and second arms is configured to be displaced in a direction perpendicular to the longitudinal axis of the divider as the lever is pivoted between the first position and second position.

14. An expandable drawer divider comprising:

a first panel and a second panel slidably connected to the first panel; and a locking mechanism including a lever, a lock member operably connected to the lever, and a linear rack provided on the second panel, the lever configured to pivot toward a first position wherein the lock member is moved in a direction parallel to a longitudinal axis of the divider and then in a direction perpendicular to the longitudinal axis of the divider into engagement with the linear rack, the lever configured to pivot toward a second position wherein the lock member is disengaged from the linear rack and the second panel is movable relative to the first panel in the direction parallel to the longitudinal axis of the divider, wherein the locking mechanism includes a compliant part and a link connecting the compliant part with the lever, the compliant part having a locking arm provided with the lock member, the locking arm is configured to be displaced in a height direction of the divider as the lever is pivoted between the first position and second position.

15. The divider of claim 14, wherein a first guide track is provided on the first panel, the lock member is slidably received in the guide track, wherein the first guide track includes a first section and a second section offset from the first section in the direction perpendicular to the longitudinal axis of the divider.

16. The divider of claim 14, wherein the compliant part includes a first slide member and a second slide member connected to the first slide member, the first slide member including the locking arm and lock member, the link pivotally connected to the second slide member, wherein the compliant part is configured to allow for sliding movement of one of the first and second slide members relative to the other of the first and second slide members.

17. The divider of claim 14, wherein a pivot axis of the lever is oriented perpendicular to the longitudinal axis of the divider and is offset in the height direction of the divider from the connection of the link with the lever.

18. An expandable drawer divider comprising:

a first panel and a second panel slidably connected to the first panel in a direction parallel to a longitudinal axis of the divider; and a locking mechanism including:

a lever, a compliant part connected to the lever, the compliant part includes a first slide member and a second slide member connected to the first slide member, a lock member provided on the first slide member, and a linear rack provided on the second panel, wherein a first guide track extended in the direction parallel to the longitudinal axis of the divider is provided on the first panel, the complaint part is slidably received in the guide track, wherein the lever is configured to pivot about a pivot axis oriented perpendicular to the longitudinal axis of the divider toward a first position wherein the compliant part is moved in the direction parallel to the longitudinal axis and the lock member is further moved in a direction perpendicular to the longitudinal axis of the divider into engagement with the linear rack, wherein with the lock member engaged to the linear rack the compliant part is configured to allow for further sliding movement of the second slide member relative to the first slide member allowing for sliding movement of the second panel toward the first panel.

* * * * *